United States Patent [19]

Bulmash et al.

[11] Patent Number: 4,480,832

[45] Date of Patent: Nov. 6, 1984

[54] EXERCISING APPARATUS

[76] Inventors: Robert Bulmash, 29 W. 382 White Oak, Warrenville, Ill. 60555; Ernest H. Medley, Sr., 803 Cambridge, Elmhurst, Ill. 60126

[21] Appl. No.: 428,572

[22] Filed: Sep. 30, 1982

[51] Int. Cl.[3] ..... A63B 21/00

[52] U.S. Cl. ..... 272/130; 272/137; 188/321.11

[58] Field of Search ..... 272/130, 137, 142; 188/321.11, 322.19, 322.22

[56] References Cited

U.S. PATENT DOCUMENTS

| | | | |
|---|---|---|---|
| 1,567,517 | 12/1925 | Kisbey | 188/321.11 |
| 2,068,578 | 1/1937 | Stronach | 272/130 |
| 3,359,802 | 12/1967 | Sollenberger | 272/130 |
| 3,369,403 | 2/1968 | Carlin | 272/130 X |
| 3,387,843 | 6/1968 | Chandler | 272/130 |
| 3,912,265 | 10/1975 | Muir | 272/130 |
| 3,984,102 | 10/1976 | Evans | 272/130 |
| 4,148,479 | 4/1979 | Spector | 272/130 |
| 4,290,599 | 9/1981 | Berger | 272/130 |

*Primary Examiner*—Richard J. Johnson
*Attorney, Agent, or Firm*—John J. Kowalik

[57] ABSTRACT

A compact exercising device in which the contractable and expandable parts are arranged in axial alignment and include a hydraulic piston and cylinder resistance coupled with an axially entensible cable and pulley system. The cylinder has its opposite ends interconnected by a conduit which incorporates a metering valve which provides a preset resistance to flow of the fluid in one direction and allows the fluid to flow quickly with little resistance in the opposite direction.

9 Claims, 2 Drawing Figures

EXERCISING APPARATUS

BACKGROUND OF THE INVENTION

This invention pertains to exercising devices. Many devices of such generic nature have been previously disclosed which purport to enhance the exercise routine. There are devices which provide a restrictive flow of fluids from one side to the other of a piston and cylinder arrangement, such as in U.S. Pat. Nos. 3,912,265 or 3,822,599, and pump-like devices are shown in U.S. Pat. Nos. 2,066,578 and 3,369,403. Push-pull isokinetic devices are shown in U.S. Pat. Nos. 4,148,479 and 3,834,696. Cables and pulleys are associated with a hydraulic metering device in U.S. Pat. Nos. 3,984,102 and 3,387,843.

SUMMARY OF THE INVENTION

This invention pertains to a device incorporating a hydraulic resistance in conjunction with a novel arrangement of pulleys and cables which are arranged to be pulled in line with the resistance to maximize the stretch required to pull the mechanism to its full extent while maintaining the assembly in compact form.

Another object is to provide a novel mechanism which provides controllable resistance for exercise movements from very slight to extremely heavy.

A further object is to devise a novel apparatus in which the resisting mechanism is coupled to an in line cable and pulley system which serves as a leverage and extends the stroke length of the apparatus to accommodate extensive body movements of the user.

These and other objects and advantages inherent in and encompassed by the invention will become more apparent in the specification and drawings, wherein.

DESCRIPTION OF THE INVENTION

Figure 1:
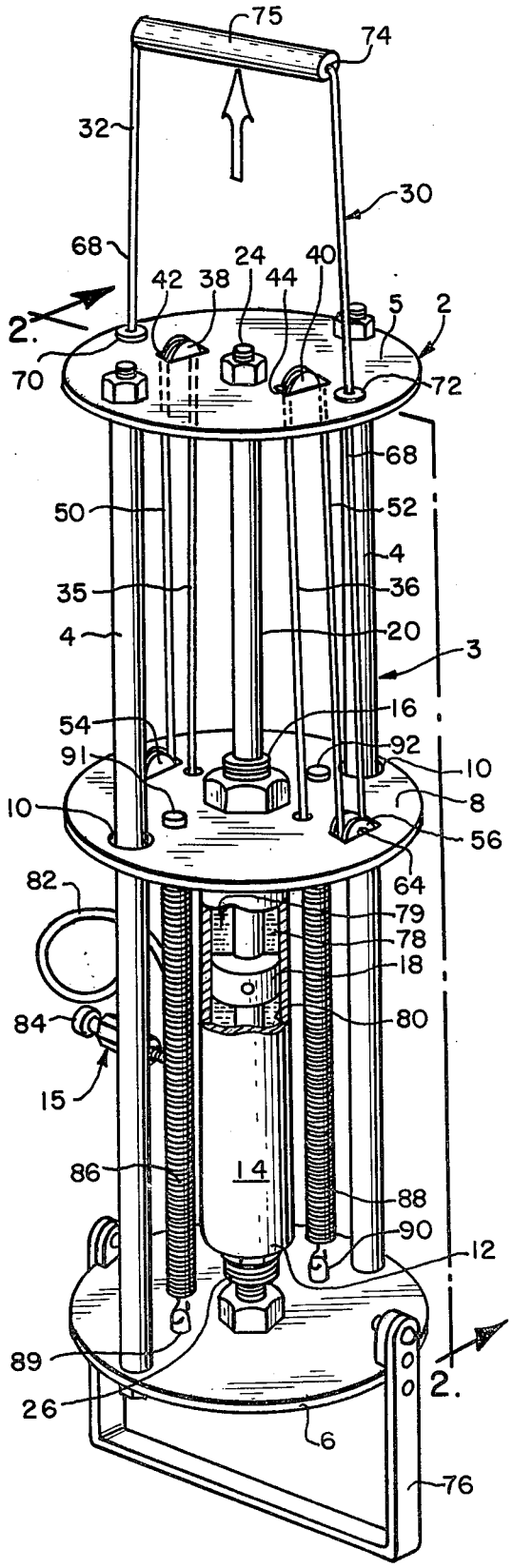
FIG. 1 is a perspective view of the novel apparatus partly in section.
Figure 2:
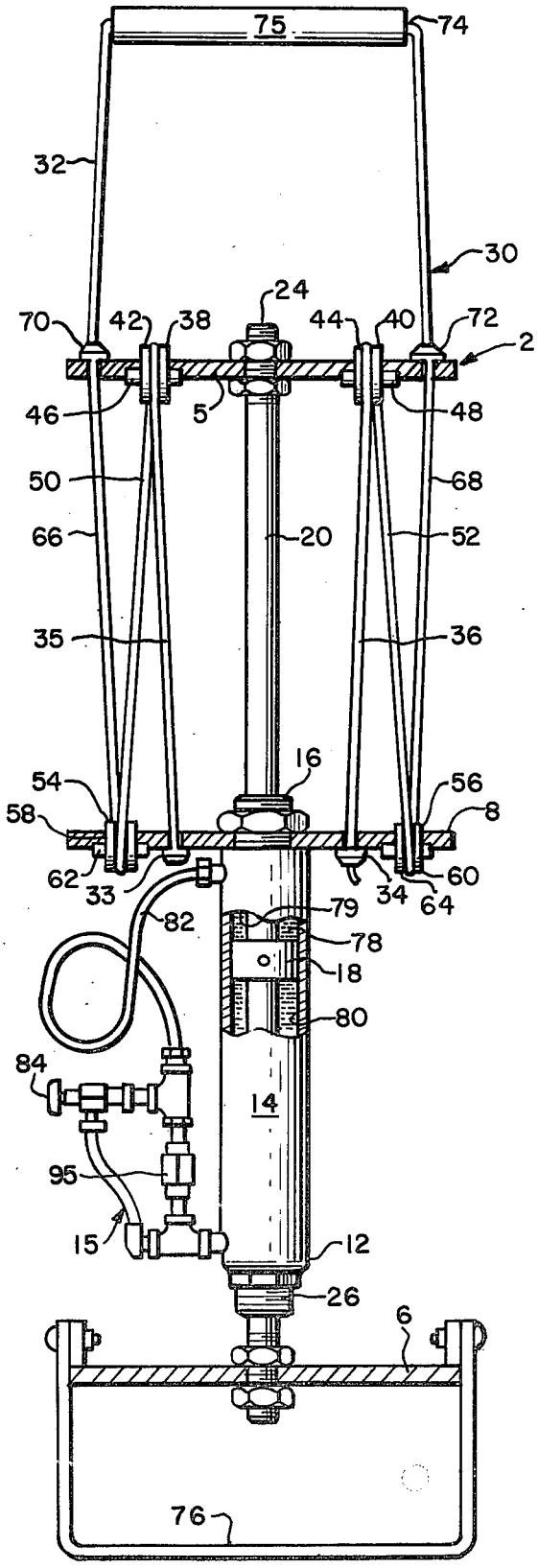
FIG. 2 is a side elevational view partly in section.

Referring to the drawings, there is shown an exercising device designated 2 comprising a frame 3 which includes a pair of longitudinal slide bars 4,4 the ends of which are secured to top and bottom plates 5 and 6 for holding them in axial alignment and a predetermined distance apart.

A guide plate 8 is positioned intermediate plates 5 and 6 and has a pair of guide apertues 10,10 through which the bars 4,4 extend.

The bottom plate 6 is positioned adjacent to the lower closed end 12 of a hydraulic cylinder 14 or a resistance generally designated 15. The upper end of the cylinder 14 is fitted with a gland element 16 which is secured to the intermediate guide plate 8 centrally thereof.

A piston 18 is fitted within the cylinder and is connected to intermediate the ends of a piston rod 20 which extends through the gland 16 in fluid-tight fit therewith. The upper end 24 of the rod is connected to the upper end plate 5 and the lower end of the rod extends through a gland 26 on the lower end of cylinder 14. The lower end of the rod is connected to the base plate 6.

A cable and pulley system 30 is provided to operate the mechanism. The system 30 comprises a cable 32 secured at its ends as at 33 and 34 at diametrically opposite sides of the piston-cylinder resistance to the guide plate 8. The cable has first lengths 35,36 extending from its ends axially of the device. The lengths 35,36 have their upper ends trained over pulleys 38,40 which are positioned in slots 42,44 in plate 5 and mounted on journals 46,48 secured to plate 5 and extending normal to the longitudinal axis of the device. The cable or cord 32 has a second set of lengths 50,52 extending axially of the device from end plate 5 toward plate 8 and are trained under pulley wheels 54,56 positioned within slots 58,60 in plate 8 at diametrically opposite sides of the resistor on journals 62,64 positioned normal to the axis of the device and secured to the plate 8.

The cord has third lengths 66,68 extending axially of the device through antifriction guides 70,72 mounted in top plate 5 at diametrically opposite sides thereof and the cord lengths 66,68 are joined by a cross length 74 which extends through a handle 75 disposed diametrically of the device.

The bottom plate is connected to a strip or stirrup 76 which accommodates the user's foot or shoe while the user pulls on the handle against the force of the resistance which comprises a suitable non-staining hydraulic fluid 78 completelly filling the upper and lower chambers 79,80 above and below the piston.

Of course, the stirrup may be replaced by a cord or other securing device so that it may be anchored to any stationary structure.

As the cable is pulled by the handle while the stirrup is held stationary, the fluid is ported from the upper cylinder chamber 79 through a conduit 82 and adjustable throttle valve 84 to the lower chamber 80.

Upon release of the handle, the pair of springs 86,88, which are positioned parallel to the cylinder, and are connected at their upper and lower ends to anchors 89,90 and 91,92 respectively provided on bottom plate 6 and intermediate plate 8, and have been extended will retract and pull the plate 8 toward plate 5 and consequently the cylinder also, whereupon the fluid which had been forced into the lower cylinder chamber will now flow back via a one way valve 95 in the line 82 thus completing the cycle.

It will be understood that a commercially well known counterbalance valve may be incorporated in the valve system such as shown in the subject brochure of the Industrial Hydraulic Division of Parker Fluidpower located in Elyria, Ohio to regulate the flow of the fluid more evenly.

We claim:

1. An exercising device comprising a pair of spaced fixedly interconnected end members and an intervening hydraulic resistance operative between said end members including a piston rod connected to said end members, and a cylinder slidable on said rod between the ends thereof and means for transferring fluid from one end of the cylinder to the other pursuant to movement of said cylinder on the rod, means for anchoring said device, and operating means for manipulating said cylinder by the user pursuant to performing exercising movements and said operating means comprises a pulley and cord mechanism reactively connected between said cylinder and one of said end members and having handhold means for grasping by the user and pulling on the same.

2. The invention according to claim 1 wherein said mechanism extends axially of the cylinder and said handhold means extending transversely of the axis of the cylinder.

3. An exercising device comprising a pair of end members and an intervening hydraulic resistance operative between said end members including a piston rod connected to said end members, and a cylinder slidable on said rod between the ends thereof and means for transferring fluid from one end of the cylinder to the other pursuant to movement of said cylinder on said rod, means for anchoring said device, and operating means for manipulating said cylinder by the user pursuant to performing exercising movements, and said operating means comprises a pulley and cord mechanism operatively connected to said cylinder, and said mechanism comprises a set of pulleys mounted on one of said end members and means mounting a complementary set of pulleys connected to one end of said cylinder, and said cord having a plurality of lengths of cord twined about said pulleys and having a portion intermediate its ends providing a handhold.

4. The invention according to claim 3 and resilient means connected between said one end of said cylinder and the end member remote from said one end for retracting the cylinder toward the same.

5. An exercise device comprising a pair of end members and an intervening hydraulic resistance operative between said end members including a piston rod connected to said end members, and a cylinder slidable on said rod between the ends thereof and means for transferring fluid from one end of the cylinder to the other pursuant to movement of said cylinder on said rod, means for anchoring said device, and operating means for manipulating said cylinder by the user pursuant to performing exercising movements, and said operating means including an intermediate member connected to one end of said cylinder and means extending between said end members for guiding said intermediate member, and a manually operable pulley and cable system connected between one of said end members and said intermediate member.

6. An exercising device comprising a pair of axially spaced base plates and an intervening cylinder and piston assembly, including a piston rod, means for securing said piston rod to one of said base plates, spacer rods interconnecting said plates, a guide member slidably mounted on said rods and connected to said cylinder, a cable and pulley assembly operatively mounted between said guide member and an adjacent one of said end plates and including a handle adapted to be pulled by the user to move said cylinder, means providing chambers and a hydraulic fluid in said cylinder at opposite sides of the piston in said chambers and adjustable means for controlling the flow of fluid between said chambers in a direction attendant to said cable and pulley assembly being pulled and fast reversing flow means upon release of said cable and pulley assembly.

7. The invention according to claim 6 and said adjustable means comprising counterbalance valve means.

8. The invention according to claim 6 and said cable and pulley assembly extending axially of said cylinder and piston assembly.

9. The invention according to claim 6 and return spring means operative between said guide member and the other of said base plates.

* * * * *